US008342772B2

(12) United States Patent
Menzenbach et al.

(10) Patent No.: US 8,342,772 B2
(45) Date of Patent: Jan. 1, 2013

(54) CIVIL ENGINEERING MACHINE FOR SPREADING MATERIAL FOR SPREADING ON SOILS OR BASE MATERIALS

(75) Inventors: Christoph Menzenbach, Neustadt/Wied (DE); Heiko Bohme, Vettelschoss (DE); Cyrus Barlmanl, Konigswinter (DE); Gunter Hahn, Konigswinter (DE)

(73) Assignee: Wirtgen GmbH (DE)

( * ) Notice: Subject to any disclaimer, the term of this patent is extended or adjusted under 35 U.S.C. 154(b) by 149 days.

(21) Appl. No.: 12/695,249

(22) Filed: Jan. 28, 2010

(65) Prior Publication Data

US 2010/0202832 A1 Aug. 12, 2010

(30) Foreign Application Priority Data

Feb. 7, 2009 (DE) ..... 10 2009 007 996

(51) Int. Cl.
*E01C 23/12* (2006.01)

(52) U.S. Cl. ..... 404/91; 239/663

(58) Field of Classification Search ..... 404/90–92, 404/101; 298/24, 27; 222/190; 239/105, 239/172, 650, 661, 663
See application file for complete search history.

(56) References Cited

U.S. PATENT DOCUMENTS

| | | | | |
|---|---|---|---|---|
| 3,701,221 | A * | 10/1972 | Vinella | 451/353 |
| 4,990,025 | A | 2/1991 | Young et al. | |
| 5,092,658 | A * | 3/1992 | Smith | 299/39.4 |
| 5,439,313 | A * | 8/1995 | Blaha et al. | 404/75 |
| 5,470,176 | A * | 11/1995 | Corcoran et al. | 404/72 |
| 6,065,922 | A * | 5/2000 | Kato et al. | 414/397 |
| 6,715,702 | B2 * | 4/2004 | McPherson et al. | 239/663 |
| 2004/0031865 | A1 * | 2/2004 | McPherson et al. | 239/663 |
| 2008/0008527 | A1 * | 1/2008 | Kraemer et al. | 404/94 |
| 2008/0267706 | A1 * | 10/2008 | Hall et al. | 404/90 |

FOREIGN PATENT DOCUMENTS

| | | | |
|---|---|---|---|
| DE | 29716423 | U1 | 1/1999 |
| DE | 20221127 | U1 | 2/2005 |
| EP | 0462899 | A1 | 12/1991 |
| EP | 1012396 | B1 | 6/2002 |

OTHER PUBLICATIONS

EPO Office Action in corresponding EPO case EP 10 00 0331 dated Feb. 8, 2012, 4 pp. (not prior art).

* cited by examiner

*Primary Examiner* — Robert Pezzuto
*Assistant Examiner* — Matthew D Troutman
(74) *Attorney, Agent, or Firm* — Waddey & Patterson, P.C.; Lucian Wayne Beavers

(57) ABSTRACT

A civil engineering machine for spreading material for spreading on soils or base materials, and in particular a civil engineering machine for spreading binders for soil or base material stabilization, has a container for material for spreading to receive the material for spreading and a spreading arrangement having one or more outlet openings for the discharge of the material for spreading. An anti-dust arrangement is arranged below the outlet openings, and is characterized in that there is created below the outlet openings a spreading compartment which is bounded by one or more first anti-dust members and in that there is created an anti-dust space which is bounded by one or more second anti-dust members.

29 Claims, 3 Drawing Sheets

CIVIL ENGINEERING MACHINE FOR SPREADING MATERIAL FOR SPREADING ON SOILS OR BASE MATERIALS

Be it known that we, Christoph Menzenbach, a citizen of Germany, residing in Neustadt/Wied, Germany; Heiko Böhme, a citizen of Germany, residing in Vettelschoss, Germany; Cyrus Barimani, a citizen of Germany, residing in Königswinter, Germany; and Günter Hähn, a citizen of Germany, residing in Königswinter, Germany, have invented a new and useful "Civil Engineering Machine For Spreading Material For Spreading On Soils Or Base Materials". This application claims benefit of German Patent Application DE 10 2009 007 996.3, filed Feb. 7, 2009.

BACKGROUND OF THE INVENTION

1. Field of the Invention

The invention relates to a civil engineering machine for spreading material for spreading on soils or base materials and in particular to a civil engineering machine for spreading binders for stabilising the soil or base material. The invention relates in this case both to a civil engineering machine which is intended solely for discharging the binder and to a civil engineering machine which has a milling or mixing rotor by which, directly after the discharge, the binder can be mixed into the soil or base material which has been milled up.

2. Description of the Prior Art

To improve or consolidate soils or base materials, it is known for binders to be introduced into them to improve their ability to be laid and their load-bearing capacity. Typical applications for soil or base material stabilization are the construction of roads, railways and surfaces for industrial use.

The known stabilizers or recyclers have a storage container for a dry binder, such as lime or cement for example, and a spreader mechanism for discharging the binders onto the soil or base material and a milling or mixing rotor by which the soil or base material can be milled up and the binder can be mixed into the soil or base material immediately after it has been discharged. What is generally mixed into the soil or base material in this case is a binder in powder form. As well as recyclers or stabilizers, what are also known are civil engineering machines by which the binder can only be applied to the soil or base material and cannot be mixed into it. These civil engineering machines are also referred to as binder spreaders.

The known binder spreaders have a storage container and a spreading mechanism for discharging the binder onto the soil or base material. Self-propelled and non-self-propelled binder spreaders are known. The non-self-propelled binder spreaders are mounted on a drawing vehicle, and in particular on a tractor, or are towed by the tractor. The self-propelled binder spreaders have a chassis which is carried by wheeled running gear and a drive unit for the wheels.

When binders in powder form are being spread, the problem arises that dust is produced. The known civil engineering machines therefore have an anti-dust arrangement in the form of a skirt which surrounds the outlet of the spreading mechanism on all sides.

In practice it has been found that the anti-dust arrangement of the known civil engineering machines is not always sufficiently good to stop dust from being produced to an adequate degree. Particularly in fairly high winds, it may happen that the binder is blown away as it emerges from the outlet of the spreading mechanism, in spite of the anti-dust arrangement.

U.S. Pat. No. 4,990,025 describes a stabilizer for mounting on a tractor. This known stabilizer has a milling or tilling and mixing rotor which is arranged in a rotor housing which comprises an injection arrangement for injecting a liquid binder. The problem of dust being produced cannot arise with a stabilizer having an injection arrangement because the material which is milled or tilled up has a liquid binder injected into it in the rotor housing.

A stabilizer or recycler which has a built-in arrangement for spreader binders in powder form is known from EP 1 012 396 B1. The binder is made available in a funnel-shaped supply container at the bottom end of which is arranged a rotary feeder by which the binder can be dispensed in a metered fashion. Provided below the rotary feeder are flexible sealing-off walls such for example as rubber flaps which surround a spreading compartment which is open at the end to the rear in the direction of travel and into which the binder is dropped. Immediately after the discharge of the binder, the milling or mixing rotor of the stabilizer or recycler travels over it and mixes it with the soil or base material which has been milled up.

SUMMARY OF THE INVENTION

The object underlying the invention is to provide a civil engineering machine for spreading material for spreading onto soils or base materials, and in particular a civil engineering machine for spreading binders for stabilising soils or base materials, in which the production of dust when the binder in powder form is being discharged is largely prevented.

The civil engineering machine according to the invention has a container for material for spreading to receive the material for spreading and a spreading arrangement having one or more outlet openings for the discharge of the material for spreading. The anti-dust arrangement of the civil engineering machine according to the invention is arranged below the one or more outlet openings.

The anti-dust arrangement is characterized in that there is formed below the one or more outlet openings of the spreading arrangement a spreading compartment which is bounded by one or more first anti-dust members, and in that an anti-dust space surrounding the spreading compartment is formed which is bounded by one or more second anti-dust members, at least the second anti-dust members which bound the anti-dust space being of a flexible form such that they are able to sweep along the ground. What is achieved in this way is that dust which occurs when the material for spreading is being discharged is first retained in the spreading compartment which is surrounded by the first anti-dust members, thus enabling the dust to settle on the ground. Quite a high proportion of the dust is trapped by this means at an early stage. The dust which is not retained in the spreading compartment is captured in the anti-dust space which is surrounded by the second anti-dust members. This is an effective way of preventing dust which arises when the material for spreading is being discharged from being able to make its way into the surroundings.

In a preferred embodiment, both the first and the second anti-dust members are flexible anti-dust members which are able to sweep along the ground. It is however also possible for only the second anti-dust members which bound the anti-dust space to reach to the ground because in the final analysis it is only the anti-dust space which needs to be closed off from the exterior.

The anti-dust arrangement preferably comprises a plurality of first and second anti-dust members which bound the spreading compartment and anti-dust space respectively. It is however also possible for only a single first and a single second anti-dust member to be provided which surround the spreading compartment and anti-dust space respectively in the form of skirts extending round in a loop. The skirt extending round in a loop is however preferably divided into a plurality of sub-sections.

A preferred embodiment of the invention makes provision for the anti-dust arrangement to have a suction extractor arrangement, which is connected to the anti-dust space, for extracting dust from the anti-dust space. The suction extractor arrangement preferably has a collecting container in which the dust is collected. The dust collected in the collecting container is preferably fed back to the container for material for spreading. The above is a particularly effective way of preventing dust from making its way from the anti-dust space into the surroundings.

A further preferred embodiment makes provision for the anti-dust arrangement to have a spraying arrangement, connected to the anti-dust space, for spraying the anti-dust space with a liquid by which the dust which arises can be bound or caused to settle. The spraying arrangement preferably has a duct having spray nozzles which is arranged in the anti-dust space, and preferably an annular duct to enable the liquid to be sprayed as evenly as possible.

The liquid may have added to it additives which promote the binding of the dust and in particular foam-forming agents may be admixed, as a result of which the anti-dust space can be at least partly flooded with foam.

Basically, it is also possible for the anti-dust arrangement to have both a suction extractor arrangement and a spraying arrangement. In practice however it is enough for either a suction extractor arrangement or a spraying arrangement to be provided.

The anti-dust space is preferably a space which surrounds the spreading compartment except for the top and bottom ends thereof. In practice however it may be enough for the anti-dust space not to completely surround the spreading compartment. For example, it is possible that less dust may be produced in the region of the longitudinal sides of the spreading compartment and the anti-dust space can therefore be open at these points.

The anti-dust members which surround the spreading compartment and the anti-dust space are preferably members which form a sort of skirt, in which case at least the anti-dust members which surround the anti-dust space are at least partly composed of a flexible material, thus enabling the anti-dust members to rest on the ground and to sweep along the ground. Unevennesses of the ground can be compensated for in this way. The anti-dust members are preferably completely composed of flexible material. It is however also possible for them to comprise a rigid anti-dust surround to which strips of flexible material are fastened.

The civil engineering machine is preferably a non-self-propelled civil engineering machine and in particular a non-self-propelled civil engineering machine for spreading binders for soil or base material stabilization which is mounted on a drawing vehicle, and in particular on a tractor, or which is towed by a drawing vehicle or which is built into a drawing vehicle. It is however also possible for the civil engineering machine to be a self-propelled civil engineering machine which has a drive unit of its own. In particular, the civil engineering machine may be a stabilizer or recycler having a built-in binder spreader.

In what follows, a number of embodiments of the civil engineering machine according to the invention for spreading material for spreading on soils or base materials will be explained in detail.

DETAILED DESCRIPTION

Figure 1:
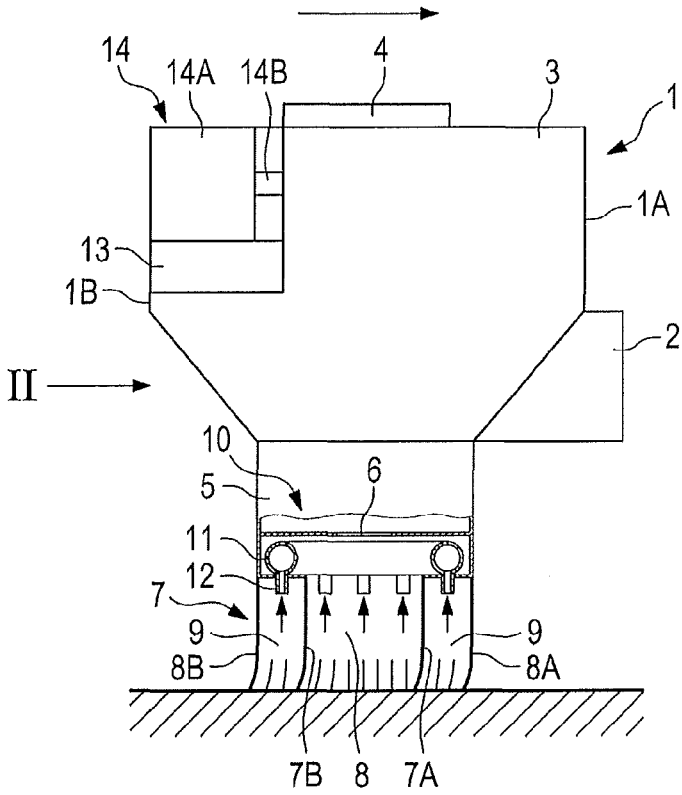
FIG. 1 is a general arrangement drawing, partly in section, of a first embodiment of non-self-propelled civil engineering machine for spreading binders for the purpose of soil or base material stabilization.
Figure 2:
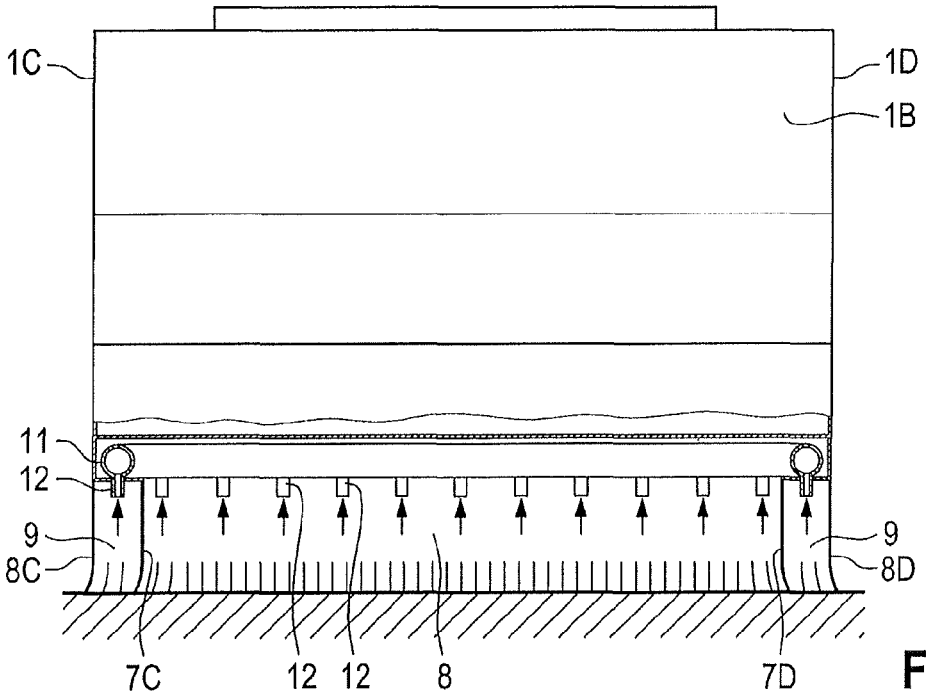
FIG. 2 is a view, partly in section, of the civil engineering machine shown in FIG. 1, looking in the direction of arrow II.

FIGS. 1 and 2 are highly simplified schematic views showing the main components of a non-self-propelled civil engineering machine for spreading binders for soil or base material stabilization, which will be referred to in what follows as a binder spreader. The binder spreader is mounted on a drawing vehicle (not shown), such as a tractor for example, which tows the binder spreader. The height of the binder spreader relative to the ground can be adjusted on the tractor.

The binder spreader has a substantially rectangular chassis 1 having a front wall 1A which is at the front in the direction of travel, a rear wall 1B which is at the rear in the direction of travel, and two side walls 1C and 1D. The mounting of the binder spreader on the tractor in such a way as to be adjustable in height is effected by means of a mounting means 2 at the front end of the chassis 1.

To receive the binder, the binder spreader has an enclosed container 3 for material for spreading which has a filling opening 4 at the top. Below the container 3 for material for spreading there is a spreading arrangement 5 which comprises a plurality of self-cleaning rotary metering feeders of the compartmented rotor type. The construction of a spreading arrangement of this kind is known to the person skilled in the art.

At its underside, the spreading arrangement 5 has one or more outlet openings 6 from which the binder emerges and falls onto the ground. This causes dust to be produced and to stop this from happening the binder spreader has an anti-dust arrangement 7.

The anti-dust arrangement 7 has anti-dust members 7A, 7B, 7C, 7D which are fastened to the front and rear walls 1A, 1B and side walls 1C, 1D respectively. The space between the underside of the spreading arrangement 5 and the ground, the sides of which space the anti-dust members surround, is referred to as the spreading compartment 8. It is not absolutely necessary for the anti-dust members to completely surround the spreading compartment on all sides. It is for example also possible for the spreading compartment to be at least partly open on the longitudinal sides.

The anti-dust members 7A, 7B, 7C, 7D are each members made of a flexible material which each form a sort of skirt-section. What may be used as flexible anti-dust members are for example rectangular pieces of film or sheet made of plastics materials or other polymers, such for example as rubber flaps or the like, which are trimmed to the dimensions of the chassis. At the bottom edges, the pieces of film or sheet may be provided with incisions arranged at a distance from one another to increase flexibility. The flexible anti-dust members are preferably sufficiently long for them to sweep along the ground when the binder spreader is moved over the ground by the tractor.

As well as this, the anti-dust arrangement 7 also has further flexible anti-dust members 8A, 8B, 8C, 8D which are arranged at a distance from the first anti-dust members. The second anti-dust members 8A, 8B, 8C, 8D which, like the first anti-dust members 7A, 7B, 7C, 7D, each take the form of a sort of skirt-section surround the first anti-dust members at the front and rear ends and at the longitudinal sides. The second anti-dust members too are sufficiently long for them to sweep along the ground when the binder spreader is moved over the ground. The space between the pairs of anti-dust members which are at the front and rear in the direction of travel of the civil engineering machine and between the lateral pairs of anti-dust members which extend in the longitudinal direction is referred to as the anti-dust space 9.

A suction extractor arrangement 10 is provided to extract the dust from the anti-dust space 9. The suction extractor arrangement 10 has an annular suction duct 11, having a plurality of suction nozzles 12 arranged at a distance from one another, which extends in the top half of the anti-dust space 9 between the first and second anti-dust members. By means of a suction duct (not shown), the annular duct 11 is connected to a means 13 of sucking air from the anti-dust space 9. The suction extractor arrangement 10 has a collecting container 14 in which the dust extracted from the anti-dust space is collected, the waste air being expelled through a filter (not shown). A means 14A which is only indicated transfers the dust collected in the collecting container 14 into the container 3 for material for spreading via a conduit 14B which is merely indicated. The collected dust may for example be blown into the container for material for spreading at the times when the suction extractor arrangement is shut down.

While the binder spreader is operating, dust which arises when the material for spreading is being discharged is first retained in the spreading compartment 8. That dust which escapes from the spreading compartment is then extracted from the anti-dust space 9 surrounding the spreading compartment by the suction extractor arrangement 10. Dust is effectively prevented from making its way into the surroundings in this way.

Figure 3:
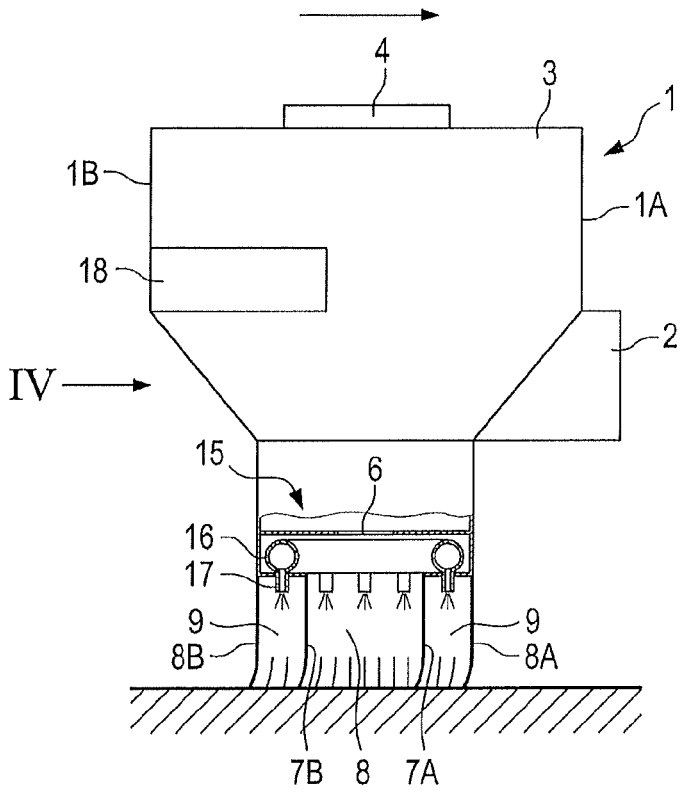
FIG. 3 is a general arrangement drawing, partly in section, of a second embodiment of the civil engineering machine.
Figure 4:
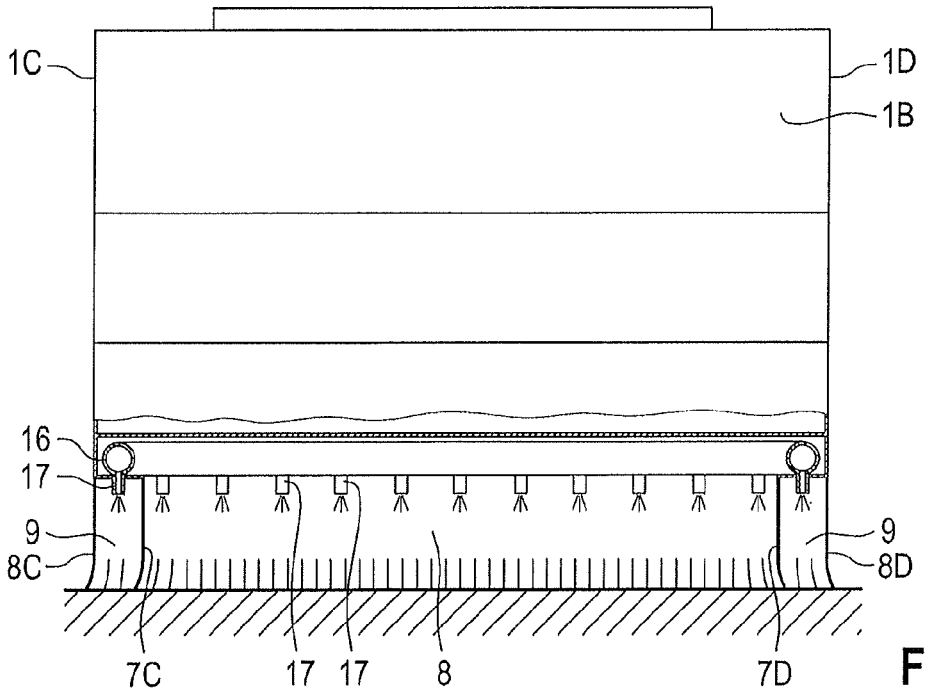
FIG. 4 is a view of the civil engineering machine shown in FIG. 3, looking in the direction of arrow IV.

FIGS. 3 and 4 show an alternative embodiment of the binder spreader which differs from the embodiment which has been described by reference to FIGS. 1 and 2 only in that a spraying arrangement is provided for the dust in place of the suction extractor arrangement. Parts which correspond to one another have therefore been given the same reference numerals. The spraying arrangement 15 once again comprises an annular duct 16 which is arranged in the top half of the anti-dust space 9, on which are provided a plurality of spray nozzles 17 arranged at a distance from one another. From the annular duct 16, a duct (not shown) for medium for spraying runs to a container 18 for medium for spraying from which medium for spraying is pumped into the annular duct 16 by a pump (not shown). The medium for spraying binds the dust which makes its way into the anti-dust space 9 or causes it to settle, thus effectively preventing any further dust from being produced. The medium for spraying preferably has admixed with it an additive which promotes the binding of the dust. What in particular is admixed with the medium for spraying is a foam-forming agent which is made available in a separate additive container and which can be fed into the container for medium for spraying. What is achieved in this way is that a foam which binds the dust forms in the anti-dust space. The foam can then be drawn down flat by those anti-dust members bounding the anti-dust space which are at the rear in the direction of travel. The carpet of foam which is left on the ground then binds the dust to the ground until the ground is milled up and the binder is mixed into it. In this way, dust can effectively be prevented from being produced even when, particularly in fairly high winds, the civil engineering machine for milling the ground only follows the binder spreader at a relatively late point in time.

The two embodiments are of a mounted binder spreader which is mounted on a tractor. The anti-dust arrangement according to the invention can however also be provided on a binder spreader which is drawn by a lorry. The binder spreader may also be a self-propelled binder spreader. In particular it may be a stabilizer or recycler having a built-in binder spreader.

Figure 5:
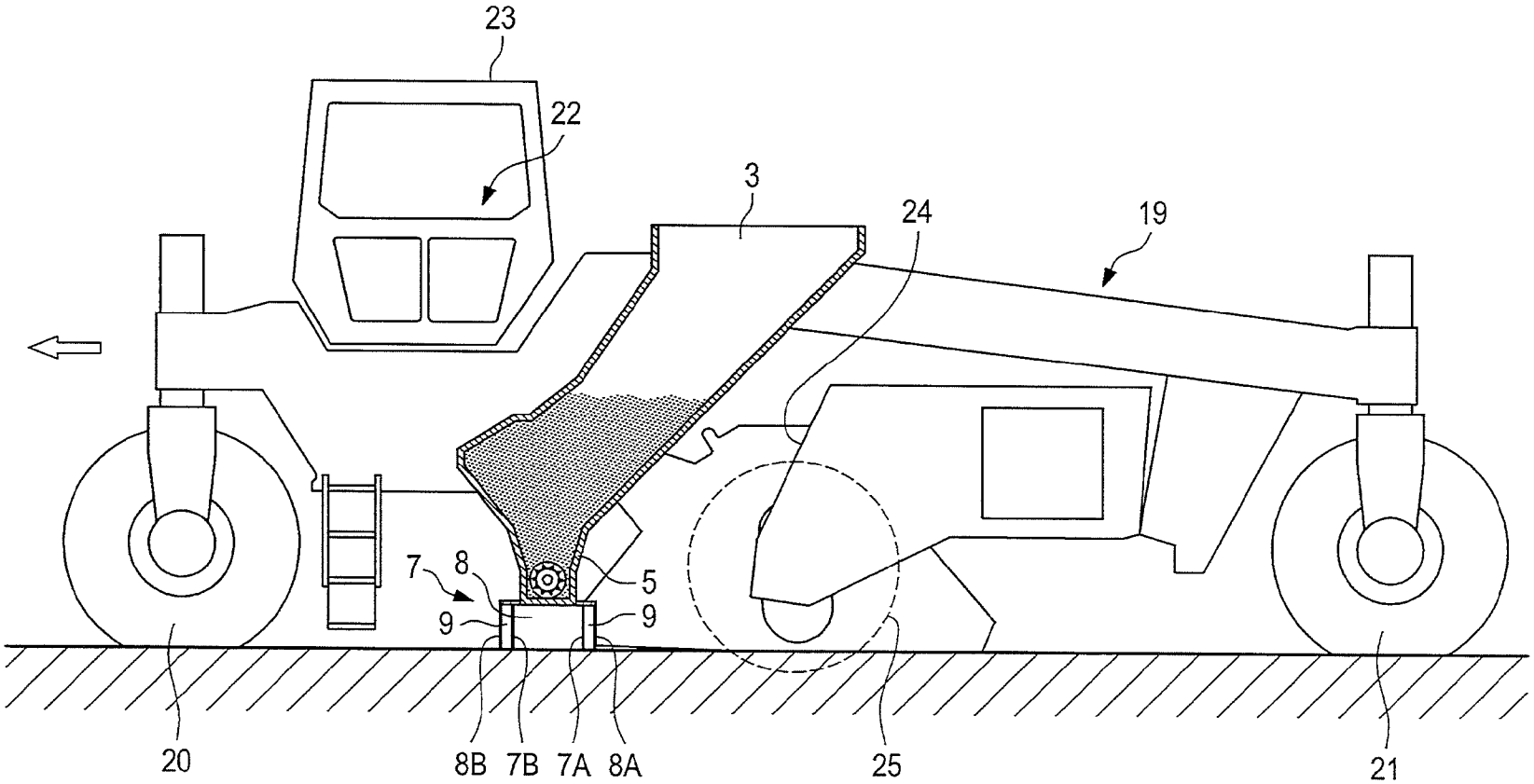
FIG. 5 is a highly simplified view of a stabilizer or recycler having a built-in arrangement for spreading binders.

FIG. 5 is a highly simplified view of a stabilizer or recycler having a built-in arrangement for spreading binders. Because the recycler or stabilizer is, except for the arrangement according to the invention for spreading binders, part of the prior art, it is only the main components of this civil engineering machine which will be described. The recycler or stabilizer, which is described as such in EP 1 012 396 B1 for example, has a chassis 19, having two front wheels 20 and two rear wheels 21, which is adjustable vertically. Arranged on the chassis 19 of the machine is a driver's position 22 having a driver's cab 23. Situated on the chassis 19 of the machine, between the front and rear wheels 19, 20, is a rotor housing 24 in which is arranged a milling or mixing rotor 25. As well as the milling and mixing rotor 25, the stabilizer or recycler also has an arrangement for spreading binder. In FIG. 5, the individual components of the arrangement for spreading binder are identified by the same reference numerals as are the corresponding components of the binder spreader which was described by reference to FIGS. 1 to 4. The built-in binder spreader has a funnel-shaped container 3 for material for spreading in which the binder is made available. Arranged below the container for material for spreading is the spreading arrangement 5 for discharging the binder. Below the spreading arrangement is situated the anti-dust arrangement 7 which, as in the case of the binder spreader shown in FIGS. 1 to 4, once again has first and second anti-dust members 7A, 8A which bound a spreading compartment 8 and an anti-dust space 9. The milling or mixing rotor 25 of the stabilizer or recycler travels over the binder which is discharged by the arrangement immediately the binder has been discharged and mixes it with the soil or base material which has been milled up.

The anti-dust arrangement 7 may have all the components of the anti-dust arrangement which is shown in FIGS. 1 to 4 even though the individual components are not shown in FIG. 6. In this way, a suction extractor arrangement or a spraying arrangement for example, such as was described in detail by reference to FIGS. 1 to 4, is also provided.

What is claimed is:

1. A civil engineering machine for spreading material for spreading on soils or base materials, having a container for material for spreading to receive the material for spreading, having a spreading arrangement having one or more outlet openings for the discharge onto a ground surface of the material for spreading, and having an anti-dust arrangement which is arranged below the one or more outlet openings of the spreading arrangement, characterized in that the anti-dust arrangement has one or more first anti-dust members which surround a spreading compartment arranged below the one or more outlet openings of the spreading arrangement, and one or more second anti-dust members which surround the first anti-dust members while forming an anti-dust space, both the first and the second anti-dust members being of a flexible form such that they are able to sweep along the ground surface.

2. The civil engineering machine according to claim 1, characterized in that the anti-dust arrangement has a suction extractor arrangement for extracting dust from the anti-dust space.

3. The civil engineering machine according to claim 2, characterized in that the suction extractor arrangement has a collecting container for dust.

4. The civil engineering machine according to claim 3, characterized in that suction extractor arrangement has a means for transferring the dust collected in the collecting container to the container for material for spreading.

5. The civil engineering machine according to claim 1, characterized in that the anti-dust arrangement has a spraying arrangement for spraying the anti-dust space with a liquid.

6. The civil engineering machine according to claim 5, characterized in that the spraying arrangement has a duct having spray nozzles which is arranged in the anti-dust space.

7. The civil engineering machine according to claim 5, characterized in that the liquid for spraying the anti-dust space has admixed with it an additive for binding the dust or causing it to settle.

8. The civil engineering machine according to claim 7, characterized in that the additive for binding the dust or causing it to settle is an additive for forming foam.

9. The civil engineering machine according to claim 1, characterized in that the anti-dust space is a space which surrounds the spreading compartment.

10. The civil engineering machine according to claim 1, characterized in that the first and/or second anti-dust members are members made at least partly of a flexible material which form a skirt.

11. The civil engineering machine according to claim 1, characterized in that the one or more first anti-dust members bounding the spreading compartment comprise front anti-dust members which are at the front in the direction of travel and rear anti-dust members which are at the rear in the direction of travel and lateral anti-dust members which extend in the longitudinal direction of the civil engineering machine.

12. The civil engineering machine according to claim 1, characterized in that the one or more second anti-dust members bounding the anti-dust space comprise front anti-dust members which are at the front in the direction of travel and rear anti-dust members which are at the rear in the direction of travel and lateral anti-dust members which extend in the longitudinal direction of the civil engineering machine.

13. The civil engineering machine according to claim 1, characterized in that the civil engineering machine is a non-self-propelled civil engineering machine for spreading binders for soil or base material stabilization which can be mounted on a drawing vehicle, or which can be towed by the drawing vehicle.

14. The civil engineering machine according to claim 1, characterized in that the civil engineering machine is a stabilizer or recycler which has a rotor for milling up the soil or base material and mixing in the material for spreading.

15. A spreading apparatus for spreading material on a ground surface, comprising:

a material container for the material;

a spreader connected to the material container, the spreader having one or more outlet openings through which the spreader can discharge the material from the material container, the one or more outlet openings being arranged such that the material freely drops from the one or more outlet openings onto the ground surface without contacting another structure;

an inner skirt including one or more inner skirt members extending downward below the one or more outlet openings of the spreader sufficiently close to the ground surface to define a spreading compartment below the one or more outlet openings to retain dust which arises when the material drops from the one or more outlet openings onto the ground surface, the spreading compartment being at least partly surrounded by the inner skirt; and an outer skirt including one or more outer skirt members, the outer skirt at least partly surrounding the inner skirt and defining a peripheral space between the inner skirt and the outer skirt to further retain dust which escapes from the spreading compartment, the one or more outer skirt members being made at least partly of a flexible material such that the one or more outer skirt members are able to sweep along the ground surface.

16. The apparatus of claim 15, further comprising:

a suction extractor communicated with the peripheral space so that the suction extractor can extract dust from the peripheral space.

17. The apparatus of claim 16, further comprising:

a collecting container communicated with the suction extractor to collect the dust extracted by the suction extractor.

18. The apparatus of claim 17, further comprising:

a transfer passage communicating the collecting container with the material container so that dust collected in the collecting container can be returned to the material container.

19. The apparatus of claim 16, further comprising:

a spraying system communicated with the peripheral space and arranged to spray a liquid into the peripheral space.

20. The apparatus of claim 15, further comprising:

a spraying system communicated with the peripheral space and arranged to spray a liquid into the peripheral space.

21. The apparatus of claim 20, wherein the spraying system comprises a duct and a plurality of spray nozzles.

22. The apparatus of claim 20, wherein the liquid includes a binding additive for binding dust in the peripheral space.

23. The apparatus of claim 22, wherein the binding additive includes a foaming agent.

24. The apparatus of claim 15, wherein the peripheral space completely surrounds the spreading compartment.

25. The apparatus of claim 15, wherein the one or more inner skirt members are made at least partly of a flexible material extending downward to sweep along the ground surface.

26. The apparatus of claim 15, wherein:

the spreading compartment is completely surrounded by the inner skirt, and the inner skirt includes one or more front inner skirt members, one or more rear inner skirt members, and one or more longitudinal inner skirt members along each of two opposite longitudinal sides of the spreading compartment.

27. The apparatus of claim 15, wherein:

the outer skirt includes one or more front outer skirt members, one or more rear outer skirt members, and one or more longitudinal outer skirt members along each of two opposite longitudinal sides of the peripheral space.

28. The apparatus of claim 15, wherein the spreading apparatus is a non-self-propelled apparatus for spreading binders for soil or base material stabilization, and includes a mount for attachment of the apparatus to a drawing vehicle.

29. The apparatus of claim 15, wherein the spreading apparatus comprises a stabilizer or recycler including a rotor for milling up the ground surface and mixing in the material from the material container.

* * * * *

UNITED STATES PATENT AND TRADEMARK OFFICE

CERTIFICATE OF CORRECTION

PATENT NO. : 8,342,772 B2
APPLICATION NO. : 12/695249
DATED : January 1, 2013
INVENTOR(S) : Menzenbach et al.

It is certified that error appears in the above-identified patent and that said Letters Patent is hereby corrected as shown below:

Title Page, Item (75), replace "Barlmanl" with --Barimani--.

Signed and Sealed this
Fourth Day of June, 2013

Teresa Stanek Rea

Teresa Stanek Rea
*Acting Director of the United States Patent and Trademark Office*